US010196230B2

(12) United States Patent
Konrad et al.

(10) Patent No.: US 10,196,230 B2
(45) Date of Patent: Feb. 5, 2019

(54) FIBER WINDING DEVICE AND METHOD FOR PRODUCING A FIBER MATERIAL BLANK

(71) Applicants: BENTELER Automobiltechnik GmbH, Paderborn (DE); BENTELER Distribution International GmbH, Duesseldorf (DE)

(72) Inventors: Stefan Konrad, Paderborn (DE); Casper Benteler, Salzburg (AT)

(73) Assignees: BENTELER AUTOMOBILTECHNIK GMBH, Paderborn (DE); BENTELER DISTRIBUTION INTERNATIONAL GMBH, Duesseldorf (DE); SGL CARBON SE, Wiesbaden (DE)

( * ) Notice: Subject to any disclaimer, the term of this patent is extended or adjusted under 35 U.S.C. 154(b) by 385 days.

(21) Appl. No.: 15/059,527

(22) Filed: Mar. 3, 2016

(65) Prior Publication Data

US 2016/0280504 A1 Sep. 29, 2016

(30) Foreign Application Priority Data

Mar. 4, 2015 (DE) ..... 10 2015 103 161

(51) Int. Cl.
*B65H 54/60* (2006.01)
*B65H 54/68* (2006.01)

(52) U.S. Cl.
CPC ..... *B65H 54/68* (2013.01); *B65H 2701/312* (2013.01); *B65H 2701/314* (2013.01)

(58) Field of Classification Search
CPC ..... B65H 2701/312; B65H 2701/314; B65H 54/106; B65H 54/20; B65H 54/68; B65H 55/005
USPC ..... 242/437.4, 448
See application file for complete search history.

(56) References Cited

U.S. PATENT DOCUMENTS 2,394,028 A * 2/1946 Volsk ..... H01F 17/02 140/92.2
2,441,564 A * 5/1948 Combs ..... H01F 21/005 140/92.2
3,874,489 A * 4/1975 Christensen ..... B65H 75/40 174/122 G
4,833,774 A * 5/1989 Jacob-Grinschgl ..... G06F 3/03543 178/19.01
4,982,560 A * 1/1991 Vives ..... B65H 81/08 242/439
5,516,384 A * 5/1996 Mossbeck ..... A47C 5/005 156/156

(Continued)

FOREIGN PATENT DOCUMENTS

CN 202609680 12/2012
CN 202704697 1/2013

(Continued)

*Primary Examiner* — Emmanuel M Marcelo
(74) *Attorney, Agent, or Firm* — Jacobson Holman, PLLC.

(57) ABSTRACT

The present invention relates to a winding device (1) and a method for winding a frame (7) to produce a fiber material blank (18). For this, a frame (7) is clamped in a clamping device and put into rotation about a rotational axis (5) by a drive (3). According to the invention it is provided that fixing pins (6) are folded down during the passing of a thread (9) to be wound.

12 Claims, 7 Drawing Sheets

(56) References Cited

U.S. PATENT DOCUMENTS

| | | | | |
|---|---|---|---|---|
| 7,498,709 | B2 * | 3/2009 | Shteynberg | H02K 15/022 242/445 |
| 2013/0106546 | A1 * | 5/2013 | Outten | H01F 27/02 336/5 |
| 2016/0126815 | A1 * | 5/2016 | Ponzio | H02K 15/095 242/440 |
| 2017/0260017 | A1 * | 9/2017 | Zaun | B65H 49/322 |

FOREIGN PATENT DOCUMENTS

| | | | |
|---|---|---|---|
| CN | 203740746 | | 4/2014 |
| DE | 7008966 | | 2/1973 |
| DE | 19549078 | | 7/1997 |
| DE | 19615070 | | 10/1997 |
| DE | 69716751 | | 7/2003 |
| DE | 102012101726 | | 9/2013 |
| DE | 102012101721 | B4 * | 11/2017 |
| SE | 508247 | | 9/1998 |

* cited by examiner

FIBER WINDING DEVICE AND METHOD FOR PRODUCING A FIBER MATERIAL BLANK

BACKGROUND OF THE INVENTION

The present invention relates to a winding device for producing a flat fibre material blank.

The present invention further relates to a method for producing a fibre material blank.

From the prior art it is known to produce automotive components made of sheet materials. These are machined using forming technology and can thus be adapted to the desired outer contour. After the machining using forming technology, the components have their end geometry.

In recent years, the production of automotive components, in particular automotive structural components, but also automotive outer skin components made of fibre composite material has increasingly established itself. For this purpose, a fibre material is used that is mixed with a matrix resin and brought into the desired shape. This shape is retained by curing the matrix resin. The component obtains its strength and rigidity through the fibres themselves and, in particular, the orientation of the fibres.

However, an automated production of fibre composite material components is not precise due to the use of matrix resin and the fact that the fibre layers and/or fibre orientations partially slip only with increased effort.

In particular, fibre material blanks should be provided, wherein in the production of the fibre material blank as little waste as possible should accrue and at the same time there is a possibility of providing the fibre orientation selectively within the fibre material blank.

A winding device is known from DE 10 2012 101 726 A1, the entire disclosure of which is incorporated into this document, in which a fibre strand or fibre roving is wound over a hollow frame. This frame is inserted into a winding device and rotated. Through teeth on the outer side of the frame, it is possible to produce a fibre material blank produced flat only on one side of the frame or, however, through respective pivoting of the fibre strand beyond the outer contour, to produce a fibre material blank produced flat on two sides, both on the front side and on the back side of the frame. It is also possible to provide selectively a winding pattern.

Due to the winding device, this method is, however, limited on the one hand to the substantially circular frame. In addition, the rotational speed and thereby also the winding speed is limited by the drive on the outer side of the frame.

BRIEF SUMMARY OF THE INVENTION

The object of the present invention is, starting from the prior art, to show a winding device and a winding method, in which mutually different external geometries of frames can be wound while optimising the winding time.

The aforementioned object is achieved with a winding device for producing a flat fibre material blank.

The procedural part is achieved with a method for producing a flat fibre material blank.

Advantageous embodiments of the invention are described in the dependent claims.

The winding device according to the invention for producing a flat fibre material blank comprising a stationary device with a drive and a clamping device, wherein a frame can be clamped in the clamping device, so that by rotation of the frame a fibre material in the form of a thread or fibre roving is wound on this, characterised in that a rotational axis is arranged centrally to the clamping device, wherein a fixing disc or star-shaped arms, on which holders are displaceably mounted, extend from the rotational axis, and on the fixing disc or the arms holders are displaceably mounted, preferably in the radial direction in relation to the rotational axis and the holders project from the fixing disc or the arms. By displacement of the holders it is possible for frames having mutually different external geometries to be clamped in the clamping device, wherein the clamping device is then set in rotation with the clamped frame via the drive. A thread eye movable relative to the frame is also provided for feeding a thread, wherein when executing the rotational movement and before the passing of each holder of the thread eye, the holder is shiftable relative to the arm or the fixing disc.

Within the meaning of the invention a thread is understood as a fibre strand of a fibre material, which, for example, may also be formed as a fibre roving. In particular, it is possible to supply different types of fibre materials, for example carbon fibres, glass fibres, ceramic fibres, aramid fibres or even metal fibres.

The substantial advantage of the invention is the central drive, which sets in rotation the whole clamping device. This can execute with respect to an outer drive a significantly faster rotational movement of the clamped frame. Within the meaning of this invention a frame is understood either as a hollow frame which has a free or empty inner region. However, within the meaning of the invention, a frame may also be understood as a solid component, which has an outer circumferential contour and then a solid inner region is wound with a thread on a front side and/or a back side. The solid frame may also be referred to as a core. This core may be formed, for example, from a foam material or even from a wax material or otherwise a plastic or even metallic material. The solid core may then be rendered from the fibre material blank or from the produced fibre composite material component, for example, or, however, remain in this. In particular, a fibre composite material hybrid component is then produced with an inner core material and an outer fibre composite material.

The rotational axis may be in the drive itself. For example, in a lathe, in particular in an electrical lathe, whose central longitudinal axis is equal to the rotational axis. Within the meaning of the invention, however, the drive may also be arranged in particular in the form of a lathe offset to the rotational axis of the winding device. Via a transmission means, for example toothed racks, toothed wheels, a belt drive or a chain drive, it is then possible to transmit the rotational movement of the drive to the arm or the fixing disc, so that these rotate about the rotational axis.

All advantageous embodiments mentioned in this text are applicable to a hollow frame and to a solid frame or a core.

A further substantial advantage of the invention is the relative displacement of the holders on the arms or the fixing disc. Hereby, a wide variety of external geometries, also referred to as an outer contour, can also be clamped by hollow frames. For example, it is possible to clamp frames with angular external geometry, for example, triangular, rectangular, square, quadratic or even other polygonal frames. Furthermore, it is possible to clamp round, oval, elliptical or other frames with curved outer contours. It is also possible to clamp mixed forms of angular and round outer contours as hollow frames. Even frames with an asymmetrical outer contour can be clamped. These are, for example, frames that have the shape of a kidney, a heart or other asymmetrical, in particular inwardly and outwardly curved, outer contours. This is made possible according to the invention in that a respective frame can be clamped by the relative movement of the holders in the radial direction. The clamped frame can, in relation to the centrally arranged drive, be arranged rotationally symmetrically central to the drive, therefore centrally. Alternatively, it is possible to arrange the frame with its central point offset to the drive. In particular, the frame is clamped parallel offset at a distance to the arms or the fixing disc, so that a front side and a back side of the frame can be wound with the respective threads.

In the context of the invention, it is particularly advantageously possible to produce two fibre material blanks on one frame at the same time. For this purpose, a first blank is produced on the front side of the frame and a second blank on the back side of the frame. Particularly preferably this is performed in a hollow frame. In particular, a separating layer or a separating means can be introduced between the first blank and the second blank. For example, a separating layer can be introduced by a separating film. This spans preferably the hollow frame before the start of the winding process. For example, the separating film can be adhered to the hollow frame. During the winding process, the separating film is then wrapped, wherein after completion of the winding process, the fibre material blanks are separated from the frame. For example, these can be cut out or punched. The separating film causes, in particular, a separation of the first blank and the second blank. For example, it is ensured through the separating layer that the blank on the front side is not adhered to the blank on the back side. The separating layer may, for example, also be formed by a glass fibre fabric, a flat or liquid separating means or the like.

In the context of the invention it is also conceivable that the threads of the flat fibre material blank are sewn together or even adhered. In particular, the fibre material blank on the front side can be sewn and/or adhered on the fibre material blank on the back side. For the adhesion, an adhesive may be applied afterwards or, however, the threads can already be mixed with an appropriate adhesive, which, for example, is thermally activated or, however, cured over a certain period, wherein the curing is concluded preferably at the earliest after completion of the winding process.

Upon reaching the thread eye or the thread itself through a mechanism, the holders are in each case passively or even actively folded away by an actuator such that the thread does not collide with the holder.

The holders themselves are arranged protruding preferably perpendicularly or orthogonally from the arms or the fixing disc. Therefore at least three holders are required, so that when one holder is folded away, there are always still at least two holders clamping the frame. Preferably, four, five or more holders are arranged. Thus the winding device is particularly for universal use, also preferably five to twenty holders are distributed radially circumferentially, so that a wide variety of external geometries can be clamped by the frame.

The holders are preferably formed by fixing pins, which extend orthogonally or perpendicularly from the arms or the fixing disc. By radial displacement of the fixing pins on the arms or the fixing disc, these then lie against the external geometry of the frame in each case and exert a clamping force in the radial direction in relation inwardly to the frame, so that the frame is clamped by the abutment of the fixing pins. However, the holders can also be formed as booms, brackets, cantilevers, beams, bars, barriers or holding arms.

Within the meaning of the invention, a displacement is understood in particular in that the fixing pins are folded away or folded down. To execute the folding movement, the fixing pins are preferably folded down outwardly in relation to the radial direction extending from the inner central drive. Alternatively, it would also be conceivable that the fixing pins rotate about the radial direction. Within the meaning of the invention, however, it is also possible that the fixing pins are offset in parallel. For this purpose, the fixing pins then preferably again shifted outwardly in the radial direction parallel to the passing of the thread and after the passing of the thread again shifted inwardly.

In particular, in the case of passively foldable fixing pins, a thrust bearing is upstream in front of the thread eye in the rotational direction, wherein particularly preferably with the winding device not only one rotational direction but two possible rotational directions are rotatable. The fixing pin passing the thread eye in each case is folded down or folded away by further rotation before reaching the thread eye by contact with the thrust bearing. After passing the thread eye, the thrust bearing then no longer rests on the fixing pin, so that the latter, for example due to a spring force action is again folded back into its clamping position resting on the outer contour of the frame. In the context of the invention, however, it is also possible that the holders are recessed, particularly in the form of fixing pins, booms or holding arms. This means, for example, in the case of the fixing disc, that they at least partially, preferably fully, protrude in the holding position with respect to a front side of the fixing disc and are recessed during the passing of the thread eye with respect to the fixing disc. The same applies in the case of the arrangement on the arms. It is hereby possible that the holders are withdrawn, screwed or even mounted on an eccentric. The thread eye itself but also the thrust bearing are also preferably mounted shiftably relative to the stationary device. The thrust bearing may be either coupled directly to the thread eye or the thrust bearing and also the thread eye are in each case also relatively mutually shiftable relative to the stationary device. It is thus possible, for example, to wind mutually different sizes of frames in each case, such that the thread leaves the thread eye and undergoes only a short transport until it reaches the outer contour of the frame.

The winding can then be effected in particular in such a way that the thread in each case is guided from a front side to the back side of the frame and then again to the front side and subsequently again to the back side. Thus it is possible to wrap the frame from both sides, so that in each case the hollow interior of the frame on the front side but also on the back side is flatly spanned by the wrapped fibre material blank and thereby forms the fibre material blank.

Particularly preferably, the frame has for this purpose outer circumferential extensions, in particular teeth, wherein when executing the rotational movement, the thread exiting from the thread eye in each case is placed in an intermediate space between two extensions and by another execution of the rotational movement is taken along by it.

In an alternative embodiment, it is also possible to form the flat fibre material blank only on the front side or only on the back side of the frame. For this purpose, the thread is wound around the extensions due to a relative movement of the thread eye in each case, such that it comes from a front side, is guided to the back side, is laid around the extension and then is guided back to the front side, so that the next section of the thread again extends over the front side due to the rotational movement.

In addition, distance holders are provided either on the frame or on the holders in each case in the radial direction, so that the holders, in particular the folding movement of the holders, is not hindered by the extensions or teeth on the outer contour of the frame.

To execute the relative movement, the holders are mounted movably in particular under a pretension in the radial direction on the arms or the fixing disc, in particular in guide grooves, wherein the guide grooves extend oriented in the radial direction. The radial direction refers in turn to the centrally located drive. The preload force is then always working towards the drive inwardly in the radial direction.

Another substantial advantage of the invention is the possibility that a plurality of frames may be wound at the same time. This is done in such a way that not only a single frame is clamped parallel to the arms or the fixing disc, but at least two, particularly a plurality of frames, are clamped at the same time offset in parallel. Preferably two to twenty, in particular two to ten, especially preferably three to ten frames are wound at the same time. When winding a plurality of frames at the same time, each frame is assigned a thread eye, so that each frame is wound by a thread eye. Within the meaning of the invention, the at least two thread eyes are then also offset in parallel and wind the frames at the same time. All frames have in this case preferably the same outer contour, so that they are clamped at the same time by the same holders, in particular fixing pins.

A further component of the invention is a counterbearing, which is arranged offset in parallel on the side opposite the drive or the arms or the fixing disc. The holder or fixing pins are mounted on the arms or the fixing disc and at its opposite end, which would normally be free, on the counterbearing. The counterbearing may, for example, also be formed as a fixing disc or as star-shaped arms oriented outwardly in the radial direction. Preferably, the counterbearing has a thrust bearing, so that the holders or fixing pins lie in the clamping position on the thrust bearing. If these are now shifted, for example by folding down or outward displacement in parallel, they detach from the thrust bearing and when adopting the fixing position, they come into contact again with or return to the thrust bearing. In particular, imbalance can therefore be avoided and in the case of the winding of a plurality of frames at the same time with the weight of the frame, which exerts a bending moment on the fixing pin, are supported by the counterbearing.

A further component of the invention is a method to produce a fibre material blank, wherein this is produced as a flat fibre material blank in a winding device according to the aforementioned features of the main claim by winding a thread on a frame and characterised by the following process steps:

- provision of a hollow frame with individually desired outer geometry, which, for example, has a round, elliptical, angular, star-shaped or asymmetrical contour, for example in the shape of a heart or shape of a kidney or other mixed form of the aforementioned contour,
- clamping of the frame by sliding the holders on the arms or the fixing disc, wherein a distance is formed between the arms or fixing disc and a back side of the frame,
- attachment of a beginning of the thread to the frame and rotation of the frame with the drive about the rotational axis,
- relative movement of the thread eye from a front side of the frame to a back side and in turn to the front side, so that in each case a section of the thread extends over the particularly hollow interior of the frame on the front side and back side, or
- relative movement of the thread eye such that the fibre exiting from the thread eye is wound around an extension on the outer side of the frame, so that the sections of the thread only extend over the front side or only over the back side of the hollow interior of the frame, removal of the fibre material blank wound on the frame.

After removing the fibre material blank, it is possible, for example, to sew or to adhere this, so that the individual sections of the thread, which extend over the flat hollow interior of the frame, are fixed in position relative to each other. So then it is possible to further process the fibre material blank, for example, the frame can be used directly as a clamping frame and be pressed through the hollow interior of the frame. It is, however, also possible to cut out the fibre material blank from the frame and, for example, to pre-form in order to subsequently supply it to a further processing method, an RIM process, for example.

Further advantages, features, properties and aspects of the present invention are the subject matter of the following description.

BRIEF DESCRIPTION OF THE DRAWINGS

Preferred embodiment variants are illustrated in the schematic figures. These serve for easy understanding of the invention.

In the figures the same reference numerals are used for the same or similar components, even if a repeated description is omitted for reasons of simplification.

DETAILED DESCRIPTION OF THE INVENTION

Figure 1:
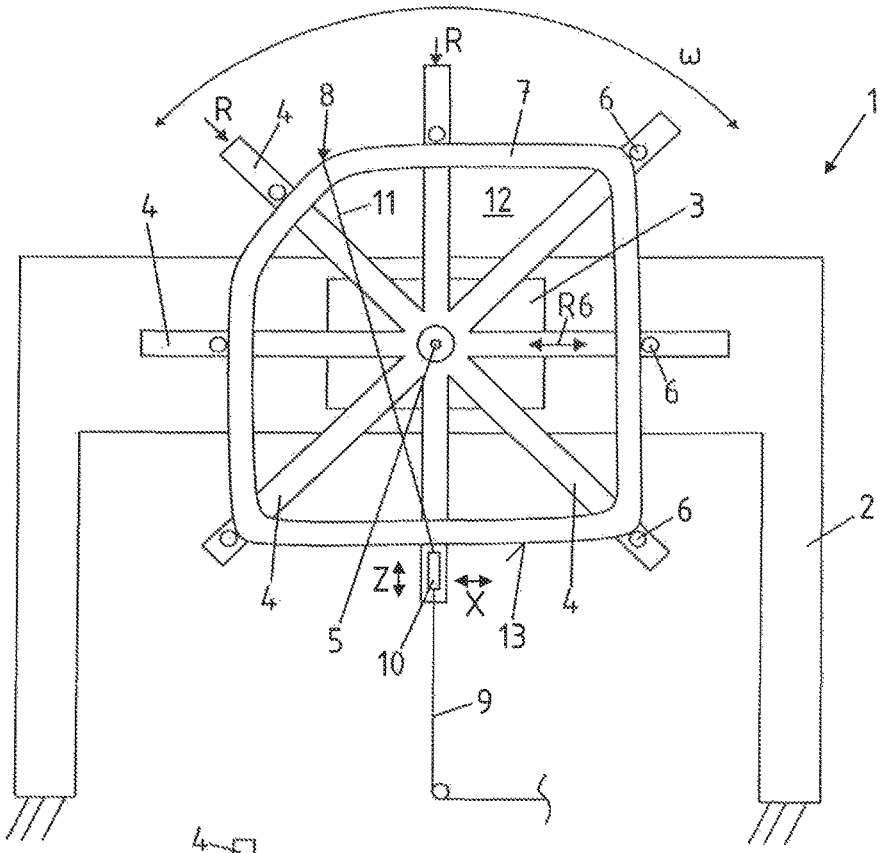
FIG. 1 shows the winding device according to the invention in front view with a clamped frame.
Figure 2:
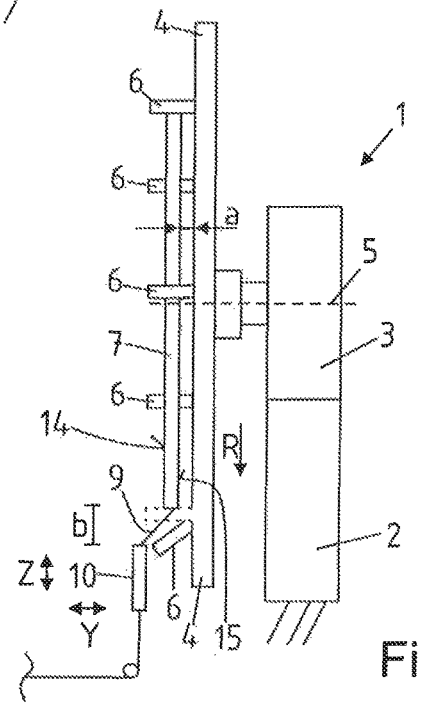
FIG. 2 shows a side view according to FIG. 1.

The winding device 1 illustrated in FIGS. 1 and 2 has a stationary device 2 to which a drive 3 is attached, wherein star-shaped arms 4 extend from the drive 3. As an alternative to the star-shaped arms 4, a continuous, non-illustrated fixing disc may also be formed. The drive 3 lies in the rotational axis 5 of the winding device 1. If the drive 3 is designed as an electric lathe, then its central longitudinal axis is equal to the rotational axis 5 of the winding device 1. The rotational axis 5 forms the central point and thus the point of rotation or the rotational axis 5 of the arms 4. The drive 3, not illustrated in detail here, may also be offset parallel to this, for example, and then the rotational movement of the drive 3 can be transferred via a timing chain or a belt drive such that the arms 4 execute a rotational movement ω about the rotational axis 5. Displaceable fixing pins 6 are mounted on the arms 4 themselves in a radial direction R in relation to the drive 3, wherein the fixing pins 6 themselves are formed protruding orthogonally towards the arms 4. The fixing pins 6 can perform a relative movement R6 on the arm 4 in each case, which is made possible, for example, by guide grooves not illustrated in detail. Between the fixing pins 6 themselves a hollow frame 7 is clamped. This frame 7 can perform a rotational movement ω, wherein the arms 4 are set in motion via the drive 3. The rotational movement ω can be performed in relation to the image plane both in the left rotational direction and in the right rotational direction. The rotational direction ω and rotational speed can also be changed in each case during the winding process according to requirements.

In order to perform the winding process, one end 8 of a thread 9, which is fed as a continuous thread via a thread eye 10, is fixed to the frame 7. The frame 7 then undergoes approximately half a rotation, substantially illustrated here, so that a section 11 of the thread 9 extends over the hollow interior 12 of the frame 7. With the passing of each fixing pin 6 of the thread eye 10, the fixing pin 6 would collide with the thread 9 itself or with the thread eye 10. In order to avoid such a collision, it is provided according to the invention that the respective fixing pin 6 passing the thread eye 10 can be folded away. In the embodiment shown here, the fixing pin 6 passing the thread eye 10 or the thread 9 is folded outwards in the radial direction R. In the frame of the invention it would also be conceivable that the fixing pin 6 is folded away rotating about the rotational direction R. The fixing pin 6 is then returned again to its clamped position (dashed line) by a spring, not illustrated in detail, for fixing the frame 7. The next fixing pin 6 in the rotational direction ω is then again folded away shortly before passing the thread 9 and respectively the thread eye 10 and after passing the thread eye 10 it also returns again to its fixing position. Also illustrated is that the thread eye 10 in both the X-direction and the Z-direction, as well as in the Y-direction, is movable relative to the clamped frame 7 or to the drive 3. In particular, through the change in height in the Z-direction, the distance b between thread eye 10 and the respective outer edge 13 of the frame 7 can be set and also through movement of the thread eye 10 in the Y-direction the thread 9 exiting from the thread eye 10 can be pivoted on a front side 14 or on a back side 15 of the clamped frame 7 and back again, so that the section 11 of the thread 9 wound via the hollow interior 12 is wound alternately over the front side 14 and the back side 15 of the frame 7.

Figure 3:
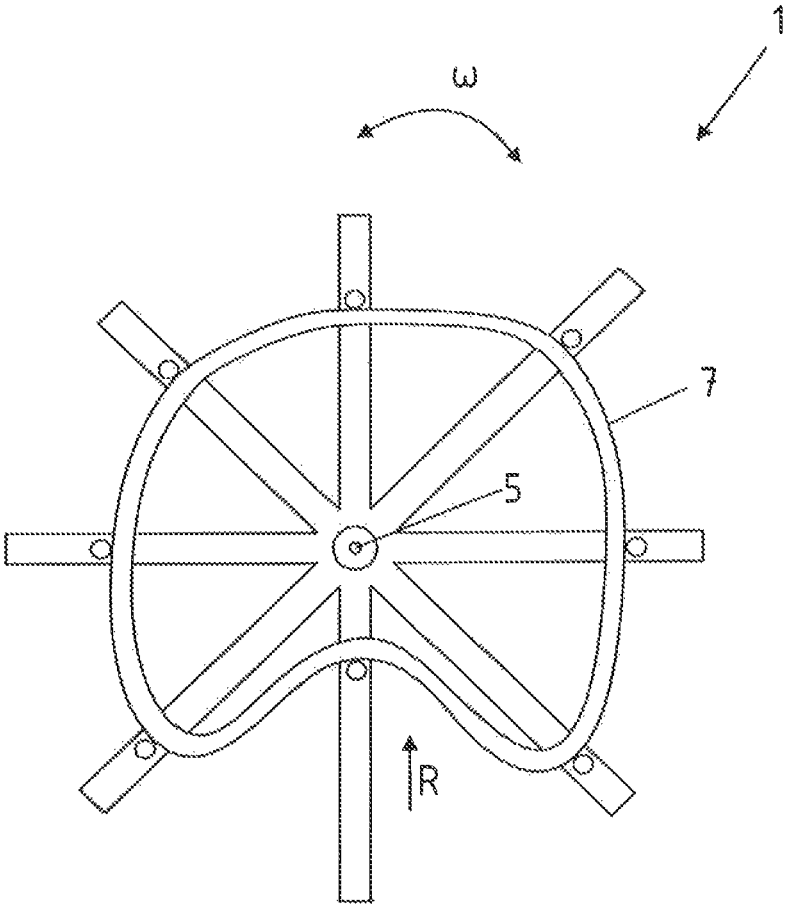
FIG. 3 shows a schematic diagram of the winding device with an asymmetrically extending frame with inwardly and outwardly oriented curves.

FIG. 3 shows a simplified embodiment of the winding device 1 with an asymmetrical, in particular kidney-shaped, extending outer contour of the frame 7. Through the rotational axis 5 of the centrally arranged drive, it is here possible to clamp a frame 7 with a thus configured outer contour on the one hand by displacement in the radial direction R in relation to the rotational axis 5 of the drive and then to let the frame 7 rotate about the rotational axis 5 of the drive.

Figure 4:
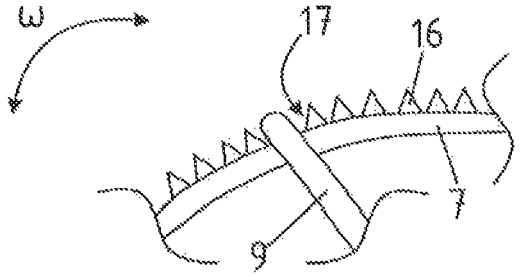
FIG. 4 shows a partial section of an outer contour of a frame with extensions protruding towards this, FIG. 5 includes FIGS. 5A-5D which shows various wound fibre material blank weaves on a frame.

FIG. 4 shows a partial section of an outer contour of a frame 7 with extensions 16 protruding towards this. The frame 7 is in each case put down in an intermediate space 17 between two extensions 16 and carried along by the additional rotational movement ω. Not illustrated in detail, the foldable fixing pins 6 either lie flat against the extensions 16 or have an additional spacer means so that when executing the folding movement, the fixing pins 6 are not hindered in the folding movement by the extensions 16.

Figure 5A:
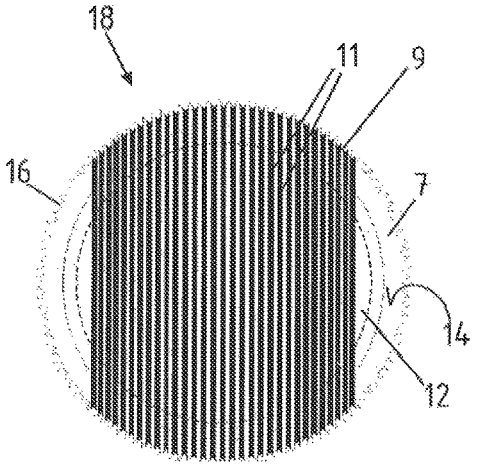

FIGS. 5A-5D show various possibilities for winding of fibre material blanks 18 on a respective frame 7. FIG. 5A shows a fibre material blank 18, in which all respective sections 11 of the thread 9 which extend over the hollow interior region 12 of the frame 7 extend unidirectionally oriented in one direction. This variant can, for example, only be wound over the front side 14 or only over the back side 15 of the frame 7 or, however, also be wound over the front side 14 and the back side 15 of the frame 7. For this purpose, the frame 7 has in each case corresponding extensions 16 on its outer circumferential contour.

Figure 5B:
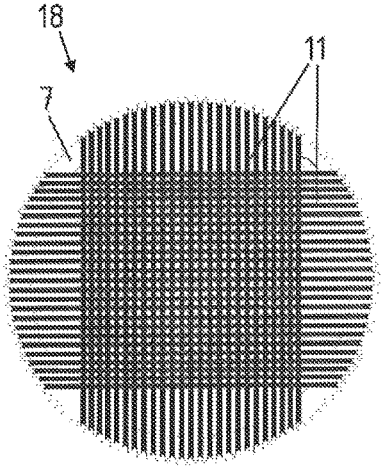

In contrast, FIG. 5B shows a winding variant, in which the respective sections substantially cross, illustrated here at right angles. Here too, it can again be wound over a front side 14 or only over a back side 15, but also over both a front side 14 and a back side 15.

Figure 5C:
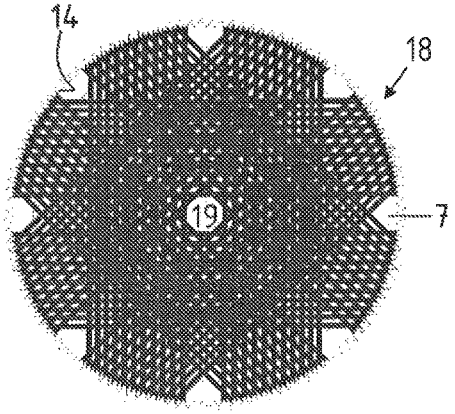

FIG. 5C shows a variant of the fibre material blank 18, in which the sections in each case are wound over the front side 14 and the back side 15 of the frame 7 and thereby extend unidirectionally to each other. Consequently, the respective sections, which extend over the inner hollow region 12 of the frame 7, are oriented in different directions and intersect. This results in an increased fibre density in a roughly centrally arranged enveloping circle region as well as a region cut out from the thread 9 in a central point 19.

Figure 5D:
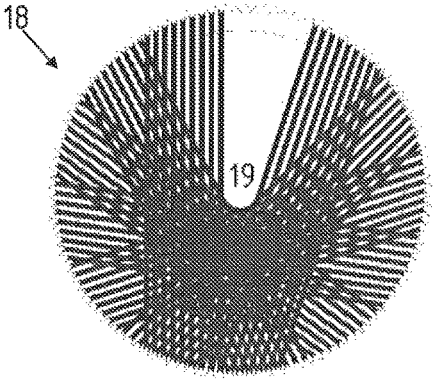

In FIG. 5D a winding is shown, in which selectively offset to the central hollow region 12 in relation to the image plane an increased fibre density is wound downwards. In particular, an asymmetrical winding has been made here so that a fibre material blank 18 is created for the production of, for example, a U-shaped extending fibre composite material component with selectively concentrated fibre density.

Figure 6:
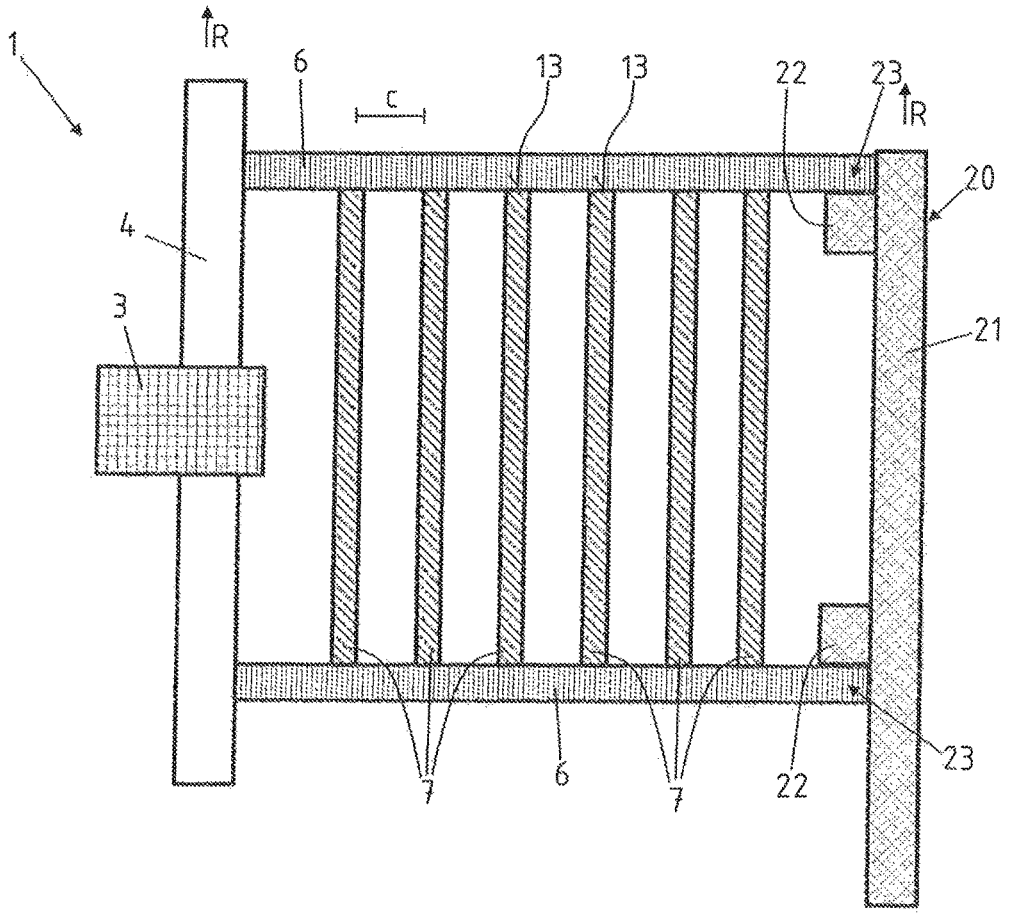
FIG. 6 shows a plan view of a winding device according to the invention with a plurality of parallel mutually offset clamped frames.

FIG. 6 shows a plan view of a winding device 1 according to the invention with a plurality of parallel mutually offset clamped frames 7. The frames 7 are arranged in each case parallel mutually offset at a distance c. The holders are again formed in the shape of fixing pins 6. From the drive 3 the arms 4 extend in the radial direction R, wherein the fixing pins 6 are then arranged displaceably on the arms 4 in the radial direction R. These make contact on a respective outer edge 13 of the outer contour of the frame 7. On the side opposite the drive 3 a counterbearing 20 is provided, wherein the counterbearing 20 also has arms 21 or a fixing disc, on which bearings 22 are arranged. A free end 23 of the fixing pins 6 is arranged in the fixing position resting on the bearings 22. The bearings 22 are also then arranged displaceably in the radial direction R on the arms 21 of the counterbearing 20. In the case of frames 7 arranged parallel mutually offset, each frame 7, not illustrated in detail in FIG. 6, is assigned its own thread eye, wherein the thread eyes are also arranged parallel mutually offset and perform the winding at the same time.

Figure 7:
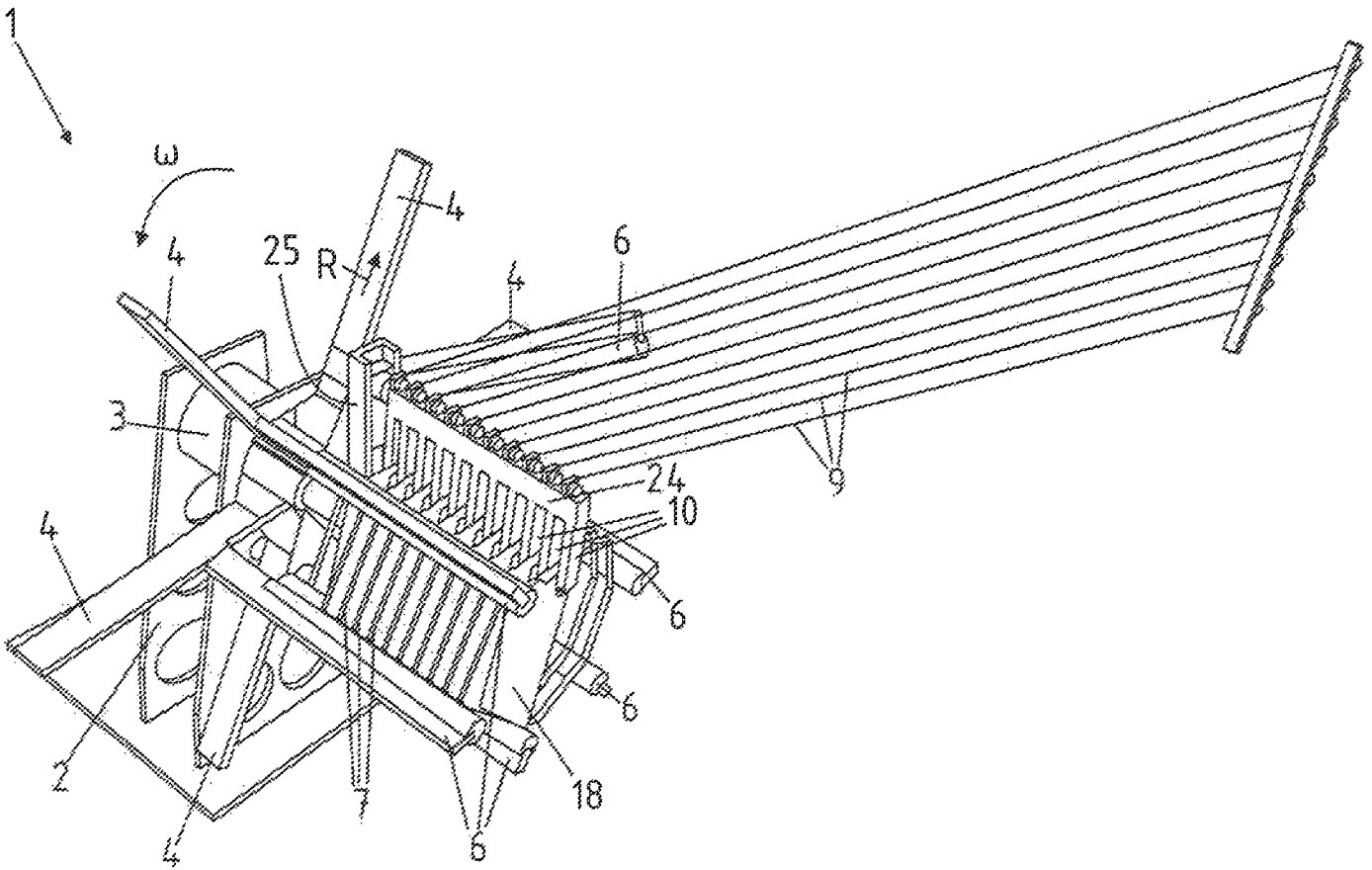
FIG. 7 shows a perspective view of a winding device according to the invention with a plurality of parallel clamped frames, FIG. 8 includes FIGS. 8A-8C which show a schematically illustrated winding process of the winding device of FIG. 7

FIG. 7 further shows a perspective view of the winding device 1 with a plurality of clamped, parallel mutually offset frames 7. The frames 7 are thereby clamped parallel mutually offset at a distance such that a fibre material blank 18 is wound on each frame 7. For this purpose, each frame 7 is assigned its own thread eye 10, wherein the individual thread eyes 10 are also arranged parallel mutually offset at a distance and each frame 7 is also supplied with its own thread 9. The winding device 1 has for this purpose star-shaped arms 4 extending from the central drive 3, wherein in each case fixing pins 6 are arranged transverse to the arms 4, wherein the fixing pins 6 work here according to the principle of a barrier or bar. The thread eyes 10 are arranged on a central rail 24. The rail 24 is pivotally mounted on a holding rail 25 in the radial direction R and in the rotational movement ω, wherein the holding rail 25 may be formed at the same time as a thrust bearing for the folding movement of the fixing pins 6.

Figure 8A:
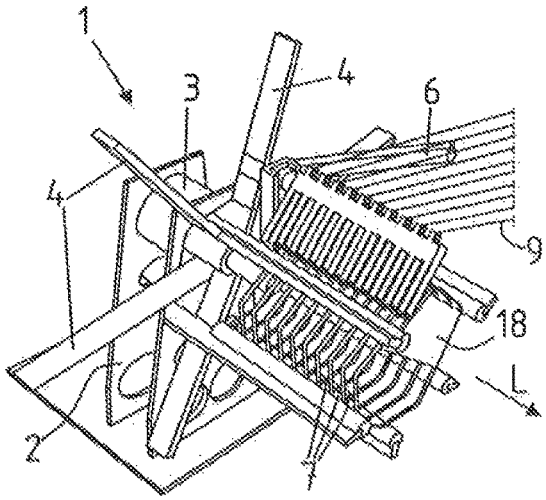
Figure 8B:
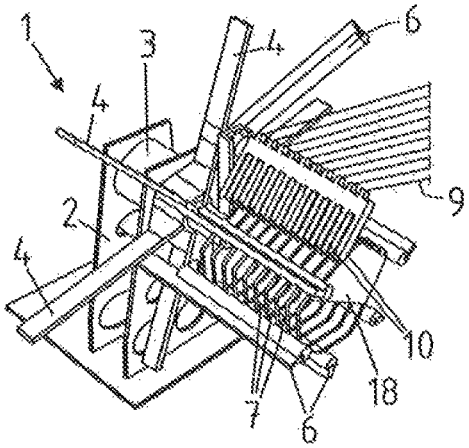

If a rotational movement ω in the illustrated direction now takes place, then the fixing pin 6 passing the thread eyes 10 or the holding rail 25 is raised in the radial direction R in relation to the outside according to the principle of a barrier. This is well illustrated in FIG. 8C, in which the fixing pin 6 passing the holding rail 25 is in the fully raised state. Also illustrated is that the thread eyes 10 are mounted movable relative to the drive 3 such that they can both enter the intermediate space between the frames 7 and can also be pivoted with respect to the frames 7. In FIG. 8A the thread eyes 10 are fully extended and in FIG. 8C these are inserted into the intermediate spaces between the frames 7. It is also possible that the thread eyes 10 are also shifted in the longitudinal direction L, in order, for example, to wind the thread 9 from a front side of the frame 7 to a back side of the frame 7.

Figure 8C:
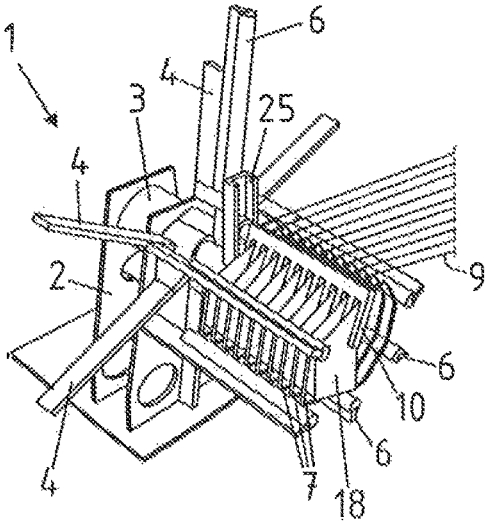

After the fixing pin 6 folded down in FIG. 8C has passed the thread eyes 10 or the holding rail 25, this folds back to the frame 7 and thus holds it fixed in position in the clamping position. The subsequent fixing pin 6 then executes the same movement when passing the thread eye 10.

Figure 9:
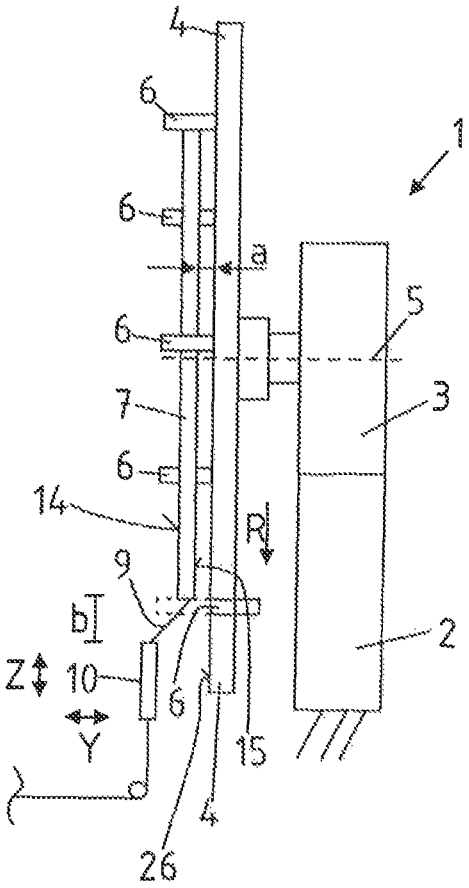
FIG. 9 shows a side view according to FIG. 2 with recessed fixing pin.

FIG. 9 shows an embodiment analogous to FIG. 2, wherein, however, the fixing pin 6 passing the thread eye 10 is not folded away, but has been recessed with respect to a front side 26 of the arm 4.

REFERENCE NUMERALS

1—winding device
2—stationary device
3—drive
4—arm
5—rotational axis of 3
6—fixing pin
7 frame
8—end of 9
9—thread
10—thread eye
11—section of 9
12—hollow interior of 7
13—outer edge of 7
14—front side of 7
15—back side of 7
16—extension
17—intermediate space
18—fibre material blank
19—centre
20—counterbearing
21—arm of 20
22—bearing
23—end of 6
24—rail
25—holding rail
26—front side of 4
ω—rotational movement
R—radial direction
R6—relative movement
a—distance
b—distance
c—distance
X—direction
Y—direction
Z—direction
L—longitudinal direction

The invention claimed is:

1. Winding device for producing a flat fibre material blank comprising a stationary device with a drive and a clamping device, wherein a frame can be clamped in the clamping device, so that by rotation of the frame a fibre material in the form of a thread or fibre roving is wound on this, wherein a rotational axis is arranged centrally to the clamping device, wherein a fixing disc or star-shaped arms, on which holders are displaceably mounted, extend from the rotational axis, and the holders project from the fixing disc or the arms, wherein by displacement of the holders, frames having mutually different external geometries can be clamped in the clamping device and are rotatable through the drive, and so that a thread eye movable relative to the frame is provided for feeding the thread, wherein when executing the rotational movement ω and before the passing of each holder by the thread eye, the holder is shiftable relative to the arm or the fixing disc.

2. The winding device according to claim 1, wherein the holders are designed as fixing pins and/or the holders in the radial direction R in relation to the rotational axis are mounted relatively displaceable to the arms or the fixing disc.

3. The winding device according to claim 2, wherein the fixing pins can be folded down outside in relation to the radial direction R to the rotational axis or that the fixing pins can be folded away rotationally about the radial direction R or that the fixing pins are displaceable in parallel with the parallel displacement taking place in the radial direction R towards the outside, or that the fixing pins are mounted retractably in relation with respect to a front of the arms or the fixing disc.

4. The winding device according to claim 2, wherein the fixing pins are passively shiftable or that the fixing pins are actively shiftable by a control actuator.

5. The winding device according to claim 4, wherein a thrust bearing is connected upstream to the passively mounted fixing pins in the rotational direction R in front of the thread eye, wherein the fixing pin passing in each case through the thread eye is shifted by the passing of the thrust bearing due to the rotational movement ω.

6. The winding device according to claim 5, wherein the thrust bearing is movably mounted relative to the stationary device.

7. The winding device according to claim 1, wherein the thread eye is movably mounted relative to the clamped frame, from a front to a back of the frame, so that the thread can be wound on the front and the back of the frame.

8. The winding device according to claim 1, wherein the frames have outer circumferential teeth, wherein when executing the rotational movement ω the thread exiting the thread eye is placed in an intermediate space between two extensions.

9. The winding device according to claim 1, wherein the holders are movably mounted under pretension in the radial direction R on the arms or the fixing disc in guide grooves, wherein the guide grooves extend in the radial direction R, and the holders are mounted parallel in the radial direction R.

10. The winding device according to claim 1, wherein at least two frames offset parallel to the arms or the fixing disc are clamped at the same time, wherein each frame is wound from a separate thread eye, wherein the at least two frames are arranged at a distance c from each other.

11. The winding device according to claim 1, wherein the frame is hollow and is wound.

12. A method for producing a fibre material blank, wherein this is produced as a flat fibre material blank in a winding device according to claim 1 by winding a thread on a frame, according to the following steps:

providing the frame with individually desired outer geometry, clamping the frame by sliding the holders on the arms or the fixing disc, wherein a distance a is formed between the arms or fixing disc and a back of the frame, attaching a beginning of the thread to the frame and rotating the frame about the rotational axis, relative movement of the thread eye from a front side of the frame to a back side and in turn to the front side, so that in each case a section of the thread covers a hollow interior of the frame on the front side and back side, or relatively moving the thread eye such that the fibre roving exiting from the thread eye is wound around an extension on an outer side of the frame, so that the sections of the thread only cover the front side or the back side of the hollow interior of the frame, removing the fibre material blank wound on the frame.

* * * * *